US011202478B2

(12) United States Patent
Barnswell

(10) Patent No.: US 11,202,478 B2
(45) Date of Patent: Dec. 21, 2021

(54) NECKTIE LOCK

(71) Applicant: Reginald Barnswell, Stockbridge, GA (US)

(72) Inventor: Reginald Barnswell, Stockbridge, GA (US)

( * ) Notice: Subject to any disclaimer, the term of this patent is extended or adjusted under 35 U.S.C. 154(b) by 0 days.

(21) Appl. No.: 16/395,367

(22) Filed: Apr. 26, 2019

(65) Prior Publication Data

US 2020/0337397 A1 Oct. 29, 2020

(51) Int. Cl.
*A41D 25/00* (2006.01)

(52) U.S. Cl.
CPC ..... *A41D 25/003* (2013.01)

(58) Field of Classification Search
CPC ..... A41D 25/003
USPC ..... 2/145
See application file for complete search history.

(56) References Cited

U.S. PATENT DOCUMENTS 1,048,393 A * 12/1912 Dewey et al. ..... A41D 25/003 2/145
1,751,963 A * 3/1930 Weinschreider ..... A41D 25/003 2/145
2,588,576 A * 3/1952 Roop ..... A41D 25/003 2/145
2,652,569 A * 9/1953 Confino ..... A41D 25/003 2/145
2,736,033 A * 2/1956 Brunetti et al. ..... A41D 25/003 2/145
2,746,055 A * 5/1956 Gleason ..... A41D 25/003 2/145
2,749,553 A * 6/1956 Miller ..... A41D 25/003 2/145
2,813,273 A * 11/1957 Schreter ..... A41D 25/003 2/145
4,920,579 A * 5/1990 Swain ..... A41D 25/003 2/145
4,972,523 A * 11/1990 Begg ..... A41D 25/003 2/137
5,109,547 A * 5/1992 Abdallah ..... A41D 25/003 2/144
5,239,707 A * 8/1993 Pileggi ..... A41D 25/003 2/145
5,245,708 A * 9/1993 Campelia ..... A41D 25/003 2/145
5,315,713 A * 5/1994 Pileggi ..... A41D 25/003 2/144
5,353,438 A * 10/1994 Voiles ..... A41D 25/003 2/145
8,056,147 B1 * 11/2011 Patel ..... A41D 25/003 2/145
2004/0181846 A1 * 9/2004 Anderson ..... A41D 25/003 2/145
2008/0034465 A1 * 2/2008 Pfanner ..... A41D 25/003 2/145
2008/0072362 A1 * 3/2008 Shearon ..... A41D 25/003 2/144
2010/0077531 A1 * 4/2010 Sale ..... A41D 25/003 2/144

(Continued)

*Primary Examiner* — Heather Mangine
(74) *Attorney, Agent, or Firm* — Ronald D. Baker; Baker & Co. Law Group

(57) ABSTRACT

What has been described is a necktie locking principle that confines movement of the necktie while in use. The intent is to secure the necktie in a general static position and limit relative movement for a larger portion of the necktie.

5 Claims, 5 Drawing Sheets

(56) References Cited

U.S. PATENT DOCUMENTS

| | | | | |
|---|---|---|---|---|
| 2017/0367419 | A1* | 12/2017 | Lewis | A41D 25/003 |
| 2020/0337397 | A1* | 10/2020 | Barnswell | A41D 25/003 |

* cited by examiner

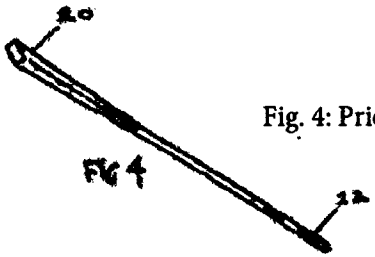
Fig. 4: Prior Art Illustration
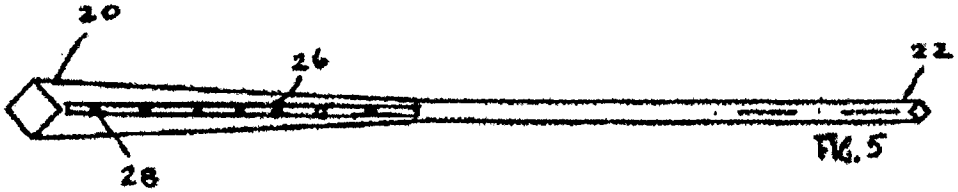
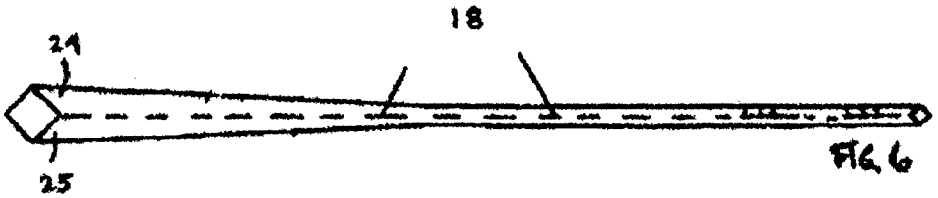
Fig. 6: Prior Art Illustration

NECKTIE LOCK

FIELD OF INVENTION

The subject disclosure relates to an improvement of clothing for securing a necktie to a dress shirt while a person is in movement. More particularly, the present disclosure relates to a fastener that attaches centrally to the rear-side of a necktie as a means of securing the necktie in place to provide an appealing look.

BACKGROUND

Neckties are typically worn for decorative purposes at various occasions such as interviews or other professional venues. The necktie can be the cornerstone of an entire outfit and is an article of clothing that has been admired by many for both its decorative and professional look. Traditionally, men have taught their sons and sometimes daughters to apply a fashionable necktie to a nice dress shirt before putting on a suit jacket to attend a formal dance for instance. The shape during wear and degree of movement during wear are of importance to the wearer. Often while in movement certain portions of the necktie will move in various positions which can be annoying at times; especially when speaking at a large gathering. This has been a concern for important figures such as corporate leaders for instance. Once a necktie has shifted out of place it causes the wearer to seem disheveled or untidy, and quite frankly a person who doesn't care about their appearance. If for example a business person is having a dinner with potential clients and leans forward while sitting and their necktie inadvertently falls into a hot plate or slides inside of their suit jacket; this can cause a very unappealing and embarrassing experience.

Consumers who wear neckties often depend on their overall appearance to make a professional statement to potential clients and peers. Now more than ever before, people are utilizing fashion to sell services and their brand. Fashion has greatly evolved over the last few decades and does not seem to be slowing down with designer brands such as Tom Ford and Ted Baker of London to name a few. A designer suit is not effectively impressive without a nice necktie to compliment the entire outfit. Traditionally, regardless of the class of necktie, a well-tailored look can fall short if the necktie is not in constant configuration with the attire as a whole.

Dealing with this irritating reality has caused individuals to desire a practical solution for a long-standing problem with regard to fashion. Most would agree that although wearing a nice suit is a wonderful feeling but having to constantly fidget with a tie is irritating to say the least not to mention what this does to your overall appearance. The public is in need of a solution such as the Necktie Lock.

BRIEF SUMMARY

The proposed invention is an article associated to clothing which can be sold as an improved necktie or alternatively as a separate immobilizing fastener that maybe attached to a pre-existing necktie. In accord with one embodiment of the Necktie Lock, the proposed disclosure is an improved necktie that can be secured in place by use of a pre-attached dress shirt button. More specifically, when the wearer adorns the necktie, the wearer can have the necktie attached to the shirt by aligning a concealed fastening strip to the corresponding buttons and subsequently coupling the buttons to the fastener via button holes. The button holes are equally dispersed along the fastener in a manner that corresponds to the pre-attached buttons on the wearer's dress shirt.

When the wearer has a need to wear formal attire, they may desire to keep their necktie from moving back and forth due to body motion. The Necktie Lock is positioned specifically in the rear portion of the wearer's necktie as a narrow elongated rectangular fastening member to accomplish a secure position of the necktie. The key to this novel invention is that it serves the purpose of securing a greater portion of a necktie in place while being concealed from the public. More specifically, the current embodiment provides a fastening member with button holes. The fastening member essentially makes up what is referred to as the Necktie Lock and is attached to the rear portion of a necktie that is ideal for formal occasions. Furthermore, the fastener extends from the rear upper middle portion near the base of the necktie knot to the rear of the wide tail portion of the necktie; the length secures a greater area of the upper middle and wide tail portion of the necktie. Since the upper middle and wide tail portion make up a majority of the necktie that is visible to the public with the exception of the knot then the length will be more effective as applied. Alternatively, if the necktie is partially restrained to the dress shirt there will e portions of the necktie that will appear bulky and lose at those points that are not restrained. The Necktie Lock will secure a greater length of the necktie in a manner that will prevent the visible portion of necktie from appearing lose and will change the wearer's perception about neckties especially if a wearer has previously felt insecure about their overall attire.

Headings of sections provided in this patent application and the title of this patent application are for convenience only and are not to be taken as limiting the disclosure in any way.

BRIEF DESCRIPTION OF THE DRAWINGS

Certain embodiments illustrating objects and advantages may be best understood by reference detailed description that follows taken in conjunction with the accompanying drawings in which:

FIG. 4 illustrates an exploded view of the rear side of the improved necktie along with perspective view of the wide and narrow-tail portions of an ordinary necktie.

FIG. 5 illustrates an exploded view of the rear side of the improved necktie along with a perspective view of the necktie lock of FIG. 2.

FIG. 6 illustrates an exploded view of the rear side of the improved necktie along with a perspective view of the middle and folded portions of an ordinary necktie.

DETAILED DESCRIPTION

Figure 1:
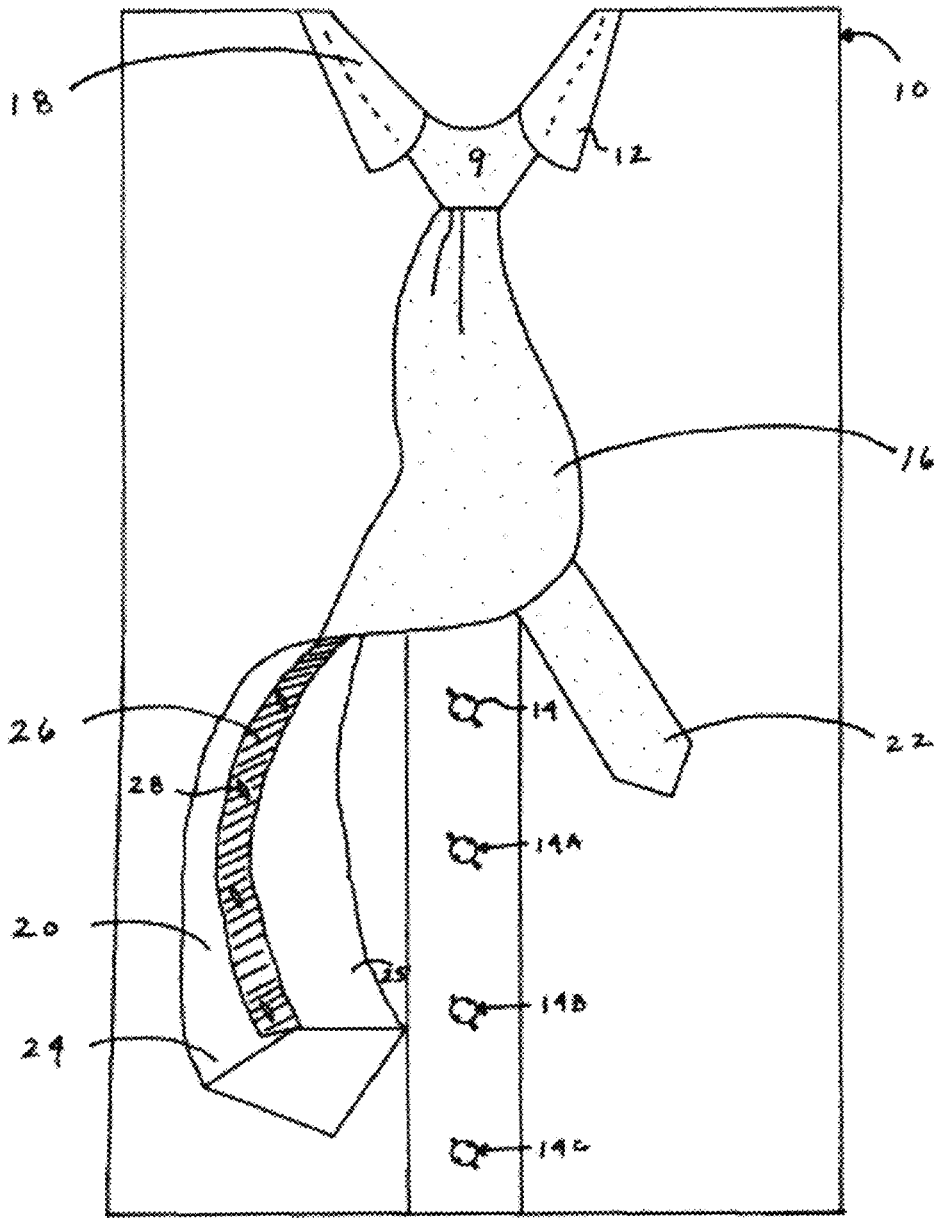
FIG. 1 is a perspective front-view of a typical necktie shown with the tail turned about 180°.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Reference throughout this document to "space" or similar terms means a particular area that make up a structure and is described in connection with the position or the embodiment that is included in an area between two or more components of the present invention. Thus, the appearances of such phrases or in various places throughout this specification are not necessarily all referring to the same embodiment. Furthermore, "space" may be described in any suitable manner by one or more embodiments without limitation.

Reference throughout this document to "attached" or similar terms indicate a means of mending a particle or material to another surface. Thus, the appearances of such phrase or in various places throughout this specification are not necessarily all referring to the same embodiment. Furthermore, "attached" may be described in any suitable manner by one or more embodiments without limitation.

Reference throughout this document to "Necktie Lock" or similar terms refer to a fastener which has at least one button hole aligned vertically for attaching to a corresponding button of a dress shirt. Thus, the appearance of similar phrases throughout this specification may not be limited to just the term Necktie Lock but when the description refers to securing a necktie to a shirt then it may be inferred that the description refers to an embodiment of the Necktie Lock.

Reference throughout this document to "garment" refers to an article of clothing that a wearer would adorn for formal purposes. The terminology can incorporate a dress shirt with a collar and buttons along the front portion for holding the garment closed. Therefore, wherever this specification refers to a garment it will not be limited to a specific type of shirt but rather any number of shirts may be referenced for purposes of the present embodiment. In a non-limiting example, the garment can be referenced as a dress shirt.

Reference throughout this document to "surface" refers to the portions of the Necktie Lock that make up the rear and front of the embodiment. Furthermore, the particular features, structures, or characteristics may be combined in any suitable manner in one or more embodiments without limitations.

Reference throughout this document to a "wide tail portion" and a "narrow tail portion" refers to the two ends of a necktie. Where ever this specification refers to a wide and narrow tail portion it refers the two opposite ends of an ordinary necktie.

Reference throughout this document to "button hole" refers to a through hole that is spaced along the surface of the present embodiment for allowing the insertion of a corresponding button of a dress shirt. Therefore, wherever this specification refers to a button hole it will not be limited to a specific hole but rather any number of through holes or voids may be combined to create a button hole for purposes of the present embodiment. In a non-limiting example, the Necktie Lock can be sold separately and attached to a pre-existing tie.

Reference throughout this document to "elastic" refers to the ability of material to stretch due to the type of material that the Necktie Lock is made of. Therefore, wherever this specification refers to elastic it will not be limited to any specific material, size or shape but rather any number of materials may be combined for purposes of the present embodiment. In a non-limiting example, the material can be made of spandex or any number of materials but is not limited to this example.

Since a necktie is used primarily for decorative purposes, it is critical that certain aspects of the necktie are not distorted and viewed as tidy. As an example, when in position encircling the neck of wearer the layers of the tie should be flat as possible to avoid any bundled areas around the wearer's neck. Other portions of the tie are equally as important such as the knot and the wide tail portion that drapes down the front of the wearer. Accordingly, most people would agree that the necktie should be neatly positioned along the dress shirt from the upper middle portion to the wide tail portion. The appearance of the necktie is a critical part of the overall appearance for the wearer and because of this the tie must remain proportionate, aligned, and most important the necktie should be aligned at all times.

Essentially when the necktie is being worn, the upper middle portion and the wide tail portion of the necktie drapes against the wearer's chest and stomach area. It is these portions of the necktie that the current invention will address and how to secure such portions of the necktie to a wearer's dress shirt in a manner that will be appealing. The Necktie Look is a novel invention that will accomplish the task of securing the upper middle and wide tail portion of the necktie. Often, a wearer will tuck the narrow tail portion of a traditional necktie in a strip of looped fabric along the rear surface of the wide tail portion or inside their dress-shirt between the two upper most buttons in a manner where the narrow tail portion is inserted inside the inner surface of the dress shirt. The Necktie Lock can be sold separately and attached to the fabric of a traditional necktie as an optional embodiment. In a non-limiting example, a wearer may select to purchase an embodiment of the Necktie Lock that can be sewn to the rear side of a pre-owned necktie. This embodiment of the Necktie Lock will be applied to the rear surface of the necktie along the middle portion extending to the wide tail portion of the necktie.

In an additional embodiment, the Necktie Lock can be marketed and sold as an improved necktie in various designs and colors to consumers. If manufactured as a complete necktie the Necktie Lock would be sold direct to consumers with the fastening member pre-attached to the rear portion of the necktie. The improved necktie version of the current embodiment will include at least one transversely extending strip of fabric along the rear-side of the wide tail portion intended to secure the narrow tail portion. The extending strip of fabric will be attached adjacent to the Necktie Lock in a manner where the strip of fabric is positioned along the vertical edges of the Necktie Lock. As a non-limiting example, a version of the Necktie Lock can be designed in a manner to where the fabric strip and the remaining tie is made in matching colors and design.

DESCRIPTION OF THE INVENTION

Referring to FIG. 1, there is illustrated a schematic view of a dress shirt 10 having-a collar 12 and a plurality of spaced apart buttons 14 (such as buttons 14, 14A, 14B, and 14C). Generally, a necktie 16 has a knot 9, a middle portion 18 interconnected about the collar 12 and typically hidden from sight of the public by the turned down collar 12. The necktie 16 is knotted 9 in any recognizable well-known manner. The necktie 16 thus forms two elongated tail portions 20, 22, extending vertically, the first of which comprises a relatively wide tail portion 20 and the second of which comprises a relatively narrow tail portion 22. Generally, with most fashionable neckties, the relatively wide tail portion 20 is usually longer in length than the narrow tail portion 22 when the necktie 16 is subsequently knotted 9. The wide tail portion 20 includes on the rear-side thereof two folded material ends 24, 25. The folded material has an overlapped end 24 and an underlapped end portion 25, the ends of both folded material 24, 25 is sewn along the rear side of the wide tail portion 20 of the necktie 16. As further illustrated in FIG. 1, a perspective schematic view is shown of the parts of the necktie 16 in position for wearing with the Necktie Lock 26 of the invention. The necktie 16 has folded portions 24 and 25 that lie flat at the rear of the wide tail portion of the necktie 20. The rear side is shown flat in its natural state to show where the Necktie Lock 26 will be attached to the rear portion of the necktie 16. The narrow tail portion 22 of the necktie 16 is shown positioned under the wide tail portion 20. As an option the narrow tail portion 22 can be tucked inside of the dress shirt 10 of the wearer between the buttons 14. It is important to point out here that the words "Necktie Lock" and "fastener" or "fastening member" are used interchangeably.

Figure 2:
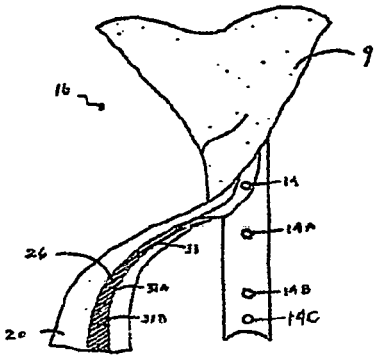
FIGS. 2, 2A, and 2B collectively depict a perspective view of the necktie, necktie lock, and transversely extending strip of fabric, showing the necktie lock attached to a dress shirt button.
Figure 2A:
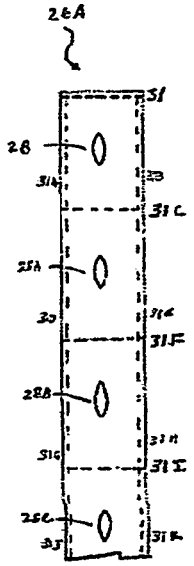
Figure 2B:
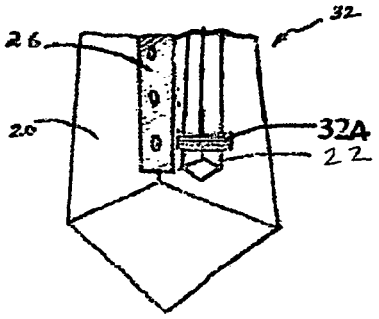

FIG. 2 shows a Necktie Lock 26 comprising an elongated strip of material 26 with a plurality of button holes 28 (that includes button holes 28A, 28B, and 28C, as depicted in the exploded view of the Necktie Lock in the FIG. 2A) along the entire length of the embodiment. Using the plurality of button holes 28, 28A, 28B, and 28C a wearer may retain the necktie 16 to the shirt 10 by coupling the buttons 14, 14A, 14B, and 14C to the Necktie Lock 26 via the plurality of button holes. In an embodiment, the fastening member (Necktie Lock 26) may be retained to the shirt 10 by use of button hole attachments, button attachments and perforating post and friction retainer devices. Additionally, the illustration in FIG. 2B shows the rear area of necktie 16 that includes an improved embodiment 32 that includes a transversely extending strip of fabric 32A for an improved necktie version positioned adjacent to the Necktie Lock 26 at a plurality of positions (as depicted in FIG. 2B) in normal use, the wearer organizes a knot 9 in the necktie 16 in a suitable manner known to the public, thereby situating the tie where the wide tail portion 20 is vertically suspended. If a wearer decides to utilize the improved version of the embodiment to include a Necktie Lock 26 and extending strip of fabric 32A pre-attached to a manufactured necktie as one complete embodiment. As illustrated the extending strip of fabric 32A are attached to either the left or right sides of the Necktie Lock in a manner not to obstruct the button holes of the Necktie Lock 26. A conventional necktie would position a similar strip of material directly in the center rear of the wide tail portion 20 of the necktie but the current embodiment proposes to attach the extended strip of fabric 32A adjacent to the Necktie Lock 26 to ensure proper attachment between the dress shirt 10 and the Necktie Lock 26 while allowing the wearer to insert the narrow tail portion 22 of the necktie into the strip of material 32A when wearing the improved version of the proposed embodiment. The Necktie Lock 26 is buttoned onto a proximate corresponding button 14 on the dress shirt 10 thereby securing the middle portion 18 and wide tail portion of the necktie 16 by restraining relative movement with respect to the shirt 10. The distributed fastening member is shown illustratively in FIG. 2 as a length of flexible material 26A, centrally attached at various points 31, 31A, 31B, 31C, 31D, 31E, 31F, 31G, 31H, 31I, 31J, and 31K. The fastening member is composed of a stretchable fabric material.

Figure 3:
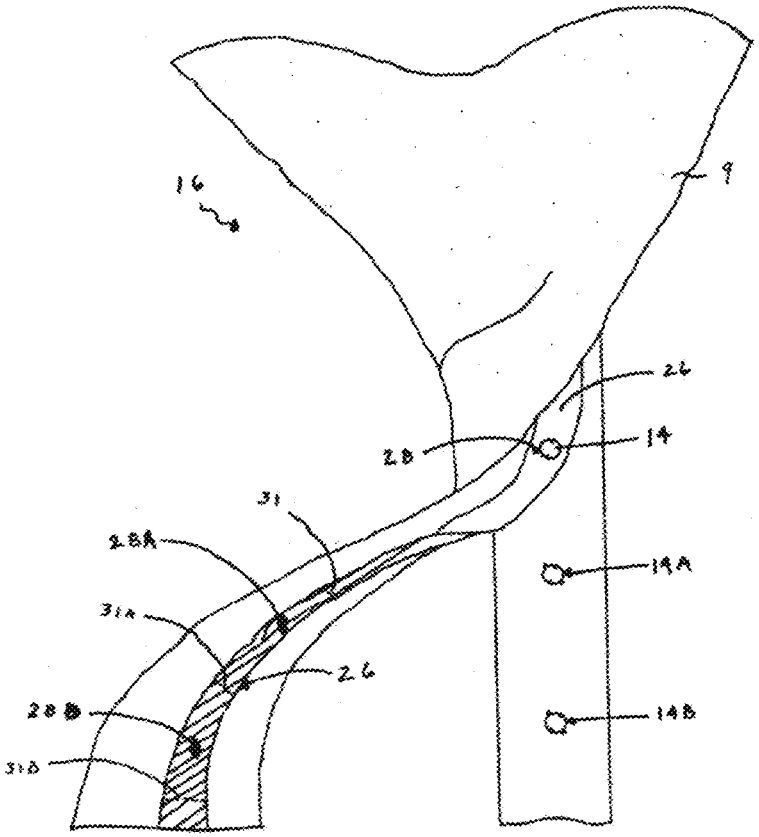
FIG. 3 is an enlarged view of the improved necktie.

FIG. 3 show an enlarged view of the Necktie Lock 26 comprising button holes 28 coupled to the buttons 14 of the dress shirt 10 by allowing the buttons 14 to pass through the button holes 28, 28A, and 28B of the Necktie Lock 26 in a manner that would attach the wide tail portion 20 of the necktie vertically to the wearer's dress shirt 10. The Necktie Lock 26 is buttoned onto a proximate corresponding button 14 on the dress shirt 10 thereby securing the wide tail portion 20 of the necktie 16 by restraining relative movement with respect to the shirt 10. In preferred form, the length of the Necktie Lock 26 is at least five inches, which provides for coverage for children and adult sized neckties with typical button spacing. This is ideal to immobilize a greater length of the necktie 16 which will provide an appealing appearance for the wearer.

As further illustrated in FIGS. 4, 6 (Prior Art Illustrations), and 5 illustrates various perspective exploded views of the rear side of the necktie 16 are shown between the parts of the improved necktie 16 and the Necktie Lock 26 of the invention. The Necktie Lock 26 is illustrated in an enlarged view to show the location of the button holes 28. The necktie has a wide tail portion 20 and narrow tail portion 22. The rear of said wide tail portion 20 is shown flat in its natural state to show where the Necktie Lock 26 will be attached to the rear side of the necktie 16. The schematic shows a view of the improved necktie 16 complete with the Necktie Lock 26 sewn to the rear of the embodiment.

Figure 7:
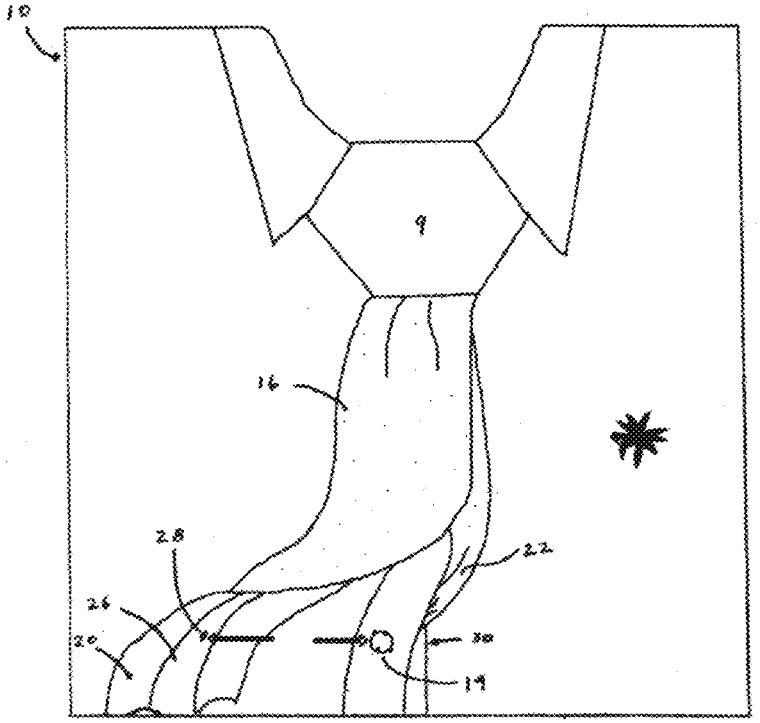
FIG. 7 illustrates a perspective view of the narrow tail portion of the improved necktie inserted inside a dress shirt.

FIG. 7 demonstrates an optional method of securing the narrow tail portion 22 inside the dress shirt 10 if the Necktie Lock 26 is applied to a pre-owned necktie as a separately purchased embodiment. Once the necktie 16 is knotted 9, the relatively narrow tail portion 22 is inserted and positioned inside the inner surface of the dress shirt 10 between spacing of the dress shirt buttons 14 as the dress shirt is creviced 30 enough to allow the insertion of the narrow tail portion 22. The Necktie Lock 26 is then coupled to the buttons 14 of the dress shirt 10 by allowing the buttons 14 to pass through the button holes 28 and attach to the Necktie Lock 26 in a manner that would secure the wide tail portion 20 of the necktie vertically to the wearer's dress shirt 10. The Necktie Lock 26 is buttoned onto a proximate corresponding button 14 on the dress shirt 10 thereby securing the wide tail portion 20 of the necktie 16 in a manner restraining relative movement with respect to the necktie 16 and the dress shirt 10.

It can thus be seen that the present invention provides a Necktie Lock which infinitely suits any positioning of the necktie and dress shirt buttons. Normal torso movements of the wearer which typically draw the necktie vertically do not dislodge the necktie particularly the knotted portion from its position site.

Whereas the present invention has been described with respect to specific embodiments thereof, it will be understood that various changes and modifications will be suggested to one skilled in the art, and it is intended to encompass such changes and modifications as it within the scope of the claims.

What is claimed is:

1. A combination of a necktie lock, a necktie, and a dress shirt comprising;

said necktie lock is an elongated fastening member, said necktie when being worn having a wide tail portion, a narrow tail portion, a first lateral edge, a second lateral edge, and front and rear sides that lay flat against said dress shirt, said wide tail portion having said elongated fastening member positioned in a vertical relationship to the wide tail portion and on said rear side thereof, said fastening member having length, width and thickness dimensions and further having portions of said fastening member attached to said wide tail portion of the necktie, said wide tail portion having a transversely extending strip of fabric, comprising in combination;

said fastening member having first and second surfaces and first and second vertical edges, wherein said second surface of said fastening member is retained to the dress shirt of a wearer using a plurality of button hole attachments; and said fastening member having a rectangular shape, wherein said transversely extending strip of fabric is attached entirely in between one of the first and second vertical edges of said fastening member and one of the first and second lateral edges of the necktie so that said transversely extending strip of fabric is attached entirely to a left or a right side of said fastening member for ensuring proper attachment between said dress shirt and said fastening member while allowing said wearer to insert said narrow tail portion of said necktie into said transversely extending strip of fabric.

2. The necktie lock of claim 1 wherein said fastening member is of a stretchable fabric material.

3. The necktie lock of claim 1 wherein the plurality of button hole attachments are equally spaced along the fastening member.

4. The necktie lock of claim 1 wherein said transversely extending strip of fabric is horizontally positioned on the rear-side of the wide tail portion.

5. The necktie lock of claim 4 wherein said transversely extending strip of fabric is attached to the rear-side of the wide tail portion in a plurality of locations.

* * * * *